US005096441A

United States Patent [19]

Jaag

[11] Patent Number: 5,096,441

[45] Date of Patent: Mar. 17, 1992

[54] SOCKET OF PLUG CONNECTOR FOR TELECOMMUNICATION SYSTEM

[75] Inventor: Dieter Jaag, Villingen-Schwenningen, Fed. Rep. of Germany

[73] Assignee: BTR Blumberger Telefon-und Relaisbau Albert Metz, Blumberg, Fed. Rep. of Germany

[21] Appl. No.: 661,395

[22] Filed: Feb. 26, 1991

[30] Foreign Application Priority Data

Feb. 26, 1990 [DE] Fed. Rep. of Germany ..... 4005924
Oct. 8, 1990 [DE] Fed. Rep. of Germany ..... 4031826

[51] Int. Cl.[5] ..... H01R 23/02
[52] U.S. Cl. ..... 439/676; 439/218
[58] Field of Search ..... 439/676, 344, 677, 680, 439/681, 636, 637, 633, 686, 695, 701, 716, 717, 217, 218

[56] References Cited

U.S. PATENT DOCUMENTS

| | | | |
|---|---|---|---|
| 3,299,392 | 1/1967 | Evans | 439/681 |
| 3,325,771 | 6/1967 | Ruehlemann et al. | 439/633 |
| 4,368,942 | 1/1983 | Mathe | 439/676 |
| 4,703,991 | 11/1987 | Philippson | 439/676 |
| 4,944,698 | 7/1990 | Siemon et al. | 439/676 |
| 4,993,972 | 2/1991 | Lin | 439/633 |

*Primary Examiner*—David L. Pirlot
*Attorney, Agent, or Firm*—Lackenbach Siegel Marzullo & Aronson

[57] ABSTRACT

In order to be able to employ one socket of a plug connector for telecommunication systems for plugs of different widths, plates can be inserted on the sides of the plug receiver (12) of the socket. The plates are guided and retained by way of ribs (22) in grooves (18) of the wall of the plug receiver (12).

8 Claims, 5 Drawing Sheets

Figure 2:
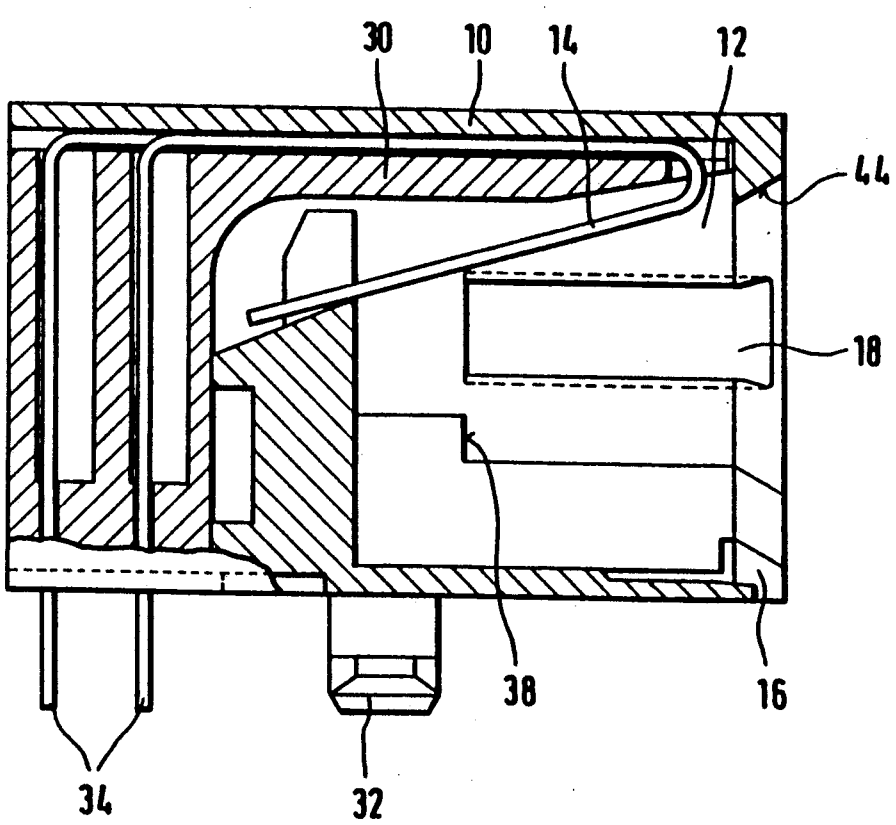

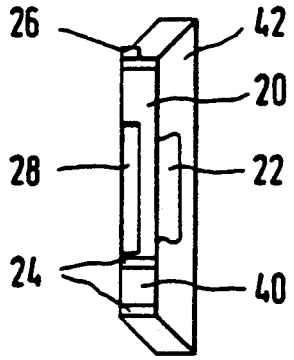
Fig. 4
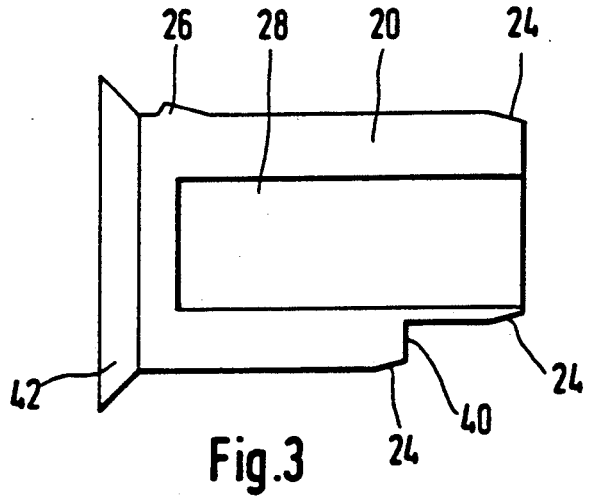
Fig.3
Fig.5
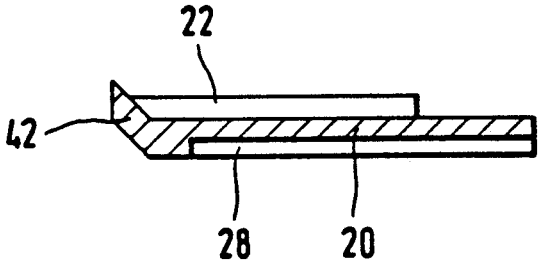
Fig.6
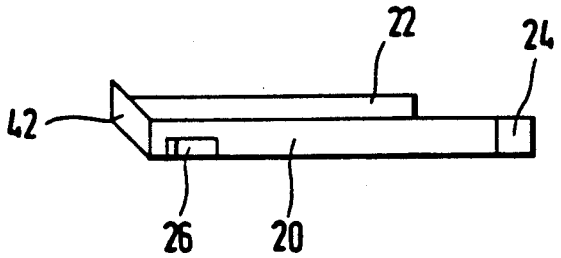
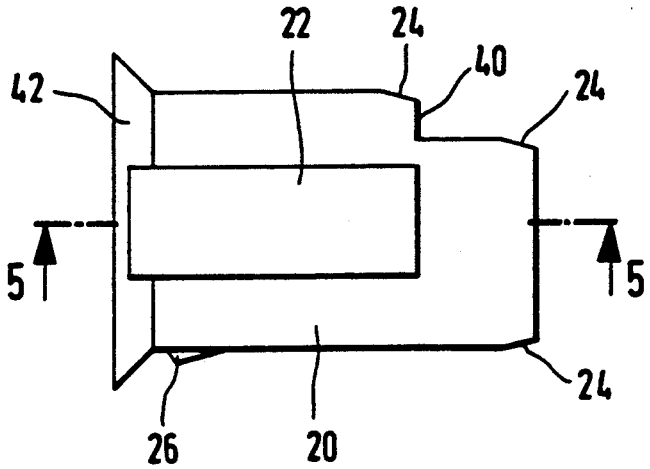
Fig.7

SOCKET OF PLUG CONNECTOR FOR TELECOMMUNICATION SYSTEM

The invention relates to a socket of a plug connector for communication systems.

Sockets of this kind are employed for telecommunication systems, where those contacts are inserted into the base face of the plug receiver which are to come in contact with the contact terminals of the plugs. Eight-pole plug connectors, having eight side-by-side contact terminals are employed in digital telecommunication systems (for example ISDN Integrated Services Digital Network), whereas while analog telecommunication systems employ six-pole plug connectors, having six side-by-side contact terminals. Correspondingly, up to now sockets with eight side-by-side contact terminals are employed for digital systems and sockets with six side-by-side contact terminals are employed for analog systems. The eight-pole sockets and plugs exhibit a larger width than the six-pole sockets and plugs. For converting a connecting box or junction box from the analog system to the digital system or vice versa, it has up to now been necessary to exchange the sockets of the connecting box.

It is an object of the present invention to furnish a socket of the initially recited kind, which is suitable for plugs of different widths.

According to the present invention, this object is achieved by the features of the appending claims.

Advantageous embodiments of the invention are stated in the sub-claims.

The invention starts with the thought that, in principle, wide sockets with eight contacts can also be employed for narrow six-pole plugs where in case of use of a six pole plug, only the connection diagram of the socket is to be changed correspondingly. This dispenses with the tiring and cumbersome exchange of the sockets in the connecting box. In addition, it is cost effective in that only one single type of socket has to be produced.

However, if the narrower six-pole plugs are inserted in the wider eight-pole sockets without lateral guide, the plug contacts can shift sideways relative to the socket contacts and contact faults can occur. Therefore, plates can be inserted on two sides into the plug receiver of the invention socket. These plates reduce the inner width of the plug receiver. Thus, a uniform socket can be employed, where the clear width of the plug receiver corresponds to the width of the widest plug. If a plug of smaller width is employed, the clear width of the plug receiver can be reduced to the width of the respectively used plug by insertion of these plates such that the narrower plug is also laterally guided.

In particular, eight-pole sockets for a digital system in particular of the ISDN system, can be inserted into the connecting box of a telecommunication system. If these connecting boxes are to be employed for the analog system, these sockets are retrofitted and changed by the inserted lateral plates to the width of the six-pole plugs of the analog system.

In order to retain the plates reliably at the side faces of the plug receiver, the plates can be shape-matchingly inserted into the plug receivers with jointing connections. Preferably, the jointing connection comprises at least one rib formed at the plate, where the rib is inserted into a coordinated groove formed in the wall of the plug receiver.

If the jointing connection is disposed between the side face of the plug receiver and the face of the plate disposed toward the plug receiver, then the ribs and the grooves exhibit preferably a dovetail profile. According to another embodiment, the grooves are in each case formed along the side faces in the floor face and the cover face of the plug receiver, wherein the ribs are formed at the upper edge and at the lower edge of the plates.

In order to hold the plates also reliably in the plug-insertion direction, advantageously, a clamping protrusion is furnished at one of the edges of the plates running in the plug-insertion direction, such that the plates are retained and held in the plug receiver based on a friction type locking.

Advantageously, a recess is furnished in the open face of the plates disposed remote relative to the side face of the plug receiver. A suitable tool, for example, a screw driver, can be operated in the recess in order to either pull or slide the plate out of the plug receiver.

Advantageously, the sockets are furnished in series on the assembly lines with the inserted side plates, such that they are suitable for the six-pole plugs of an analog system. If a digital system with eight-pole plugs is to be connected or if the analog system is to be retrofitted and changed over to such an eight-pole system, then it is only necessary to remove the plates from of the sockets. In particular, the plates can also be removed where the connecting boxes are already mounted.

The invention is illustrated in more detail by way of the exemplified embodiments illustrated in the drawings.

Figure 1:
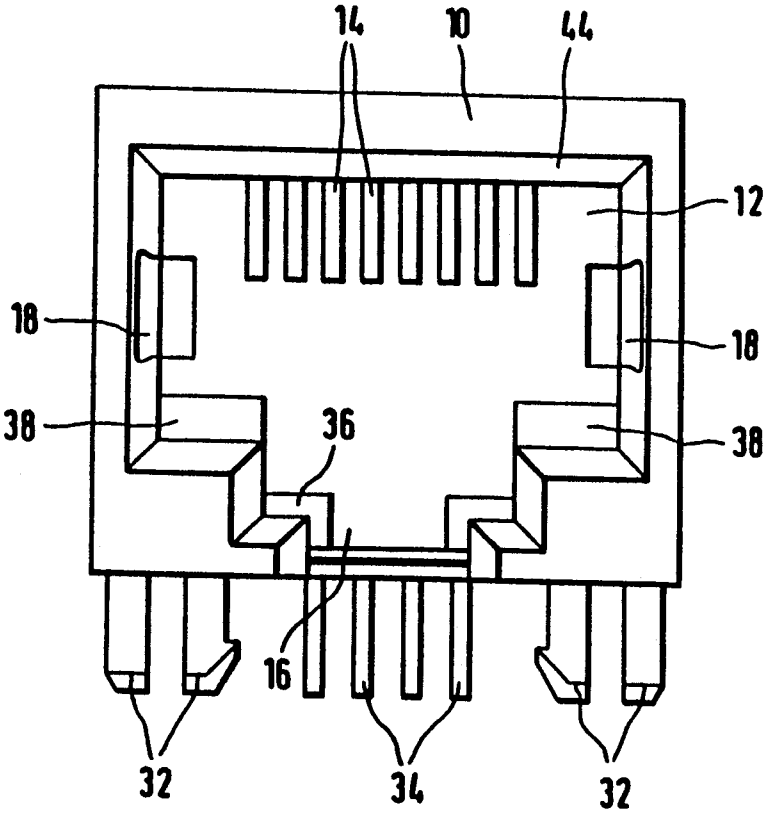
Figure 9:
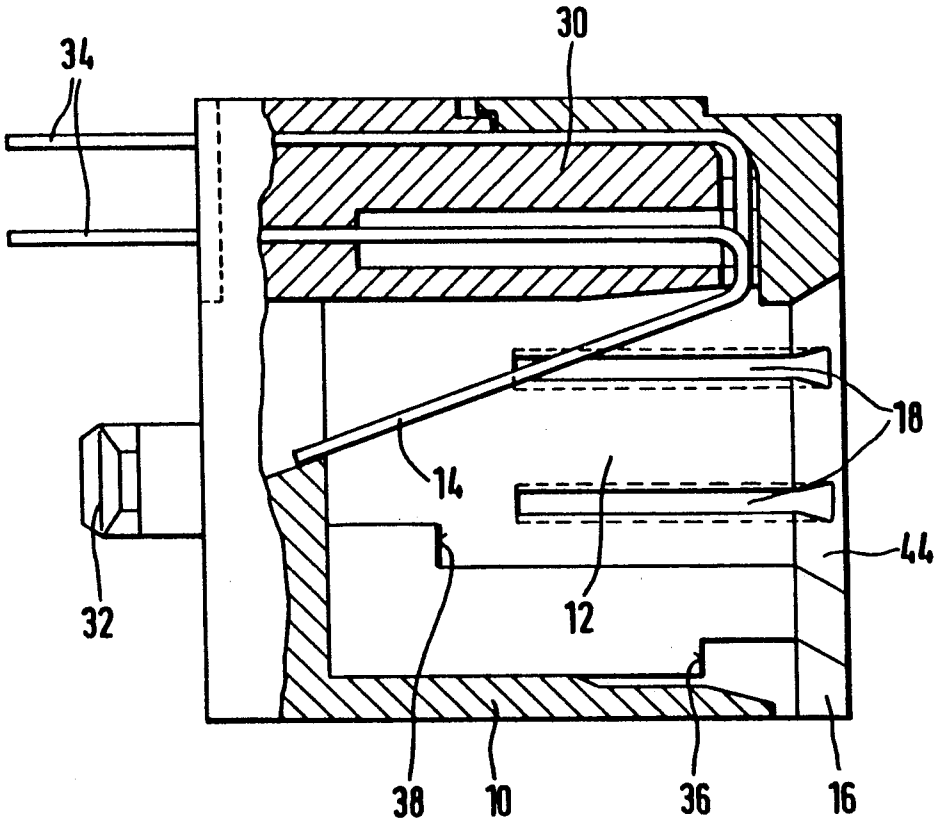
Figure 8:
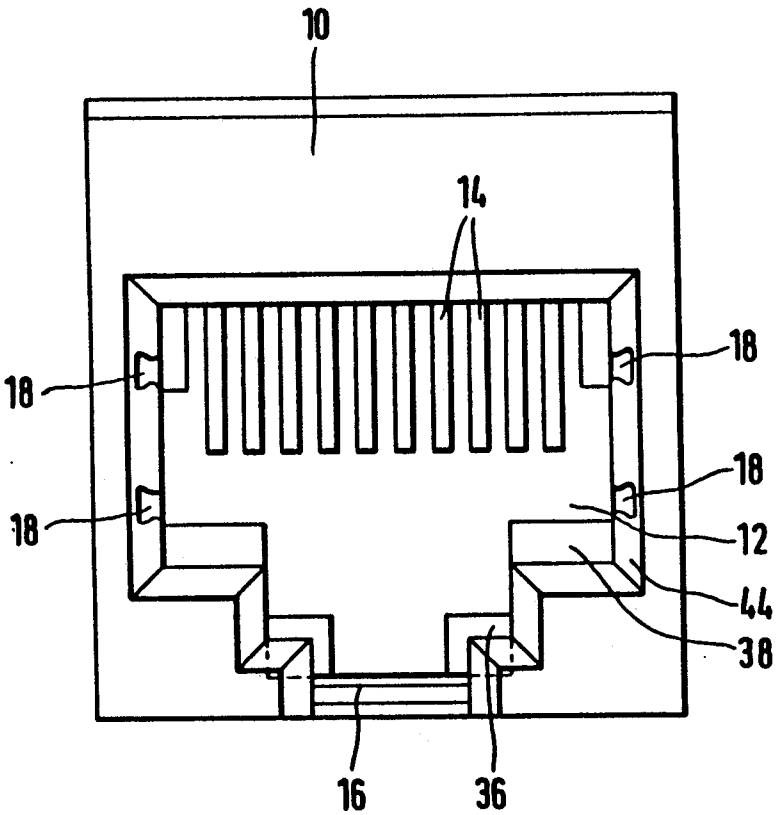
Figure 11:
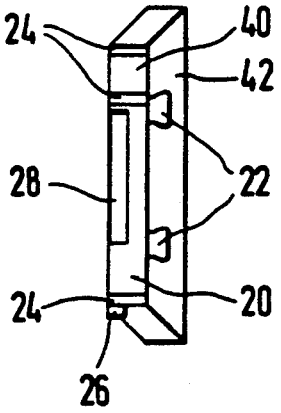
Figure 10:
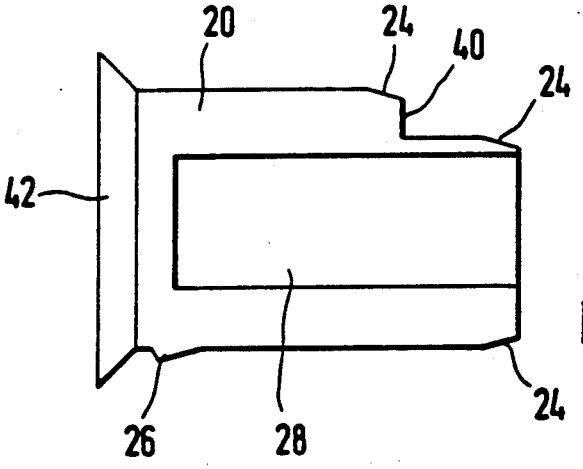
Figure 12:
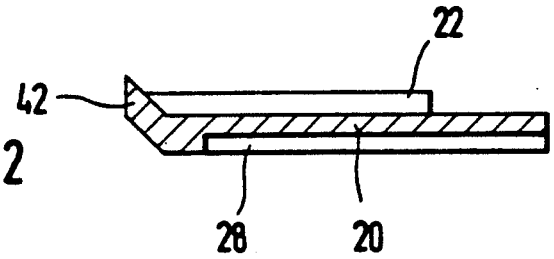
Figure 13:
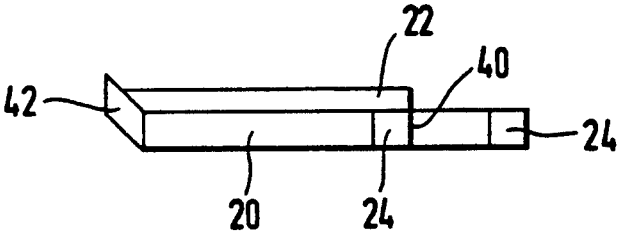
Figure 14:
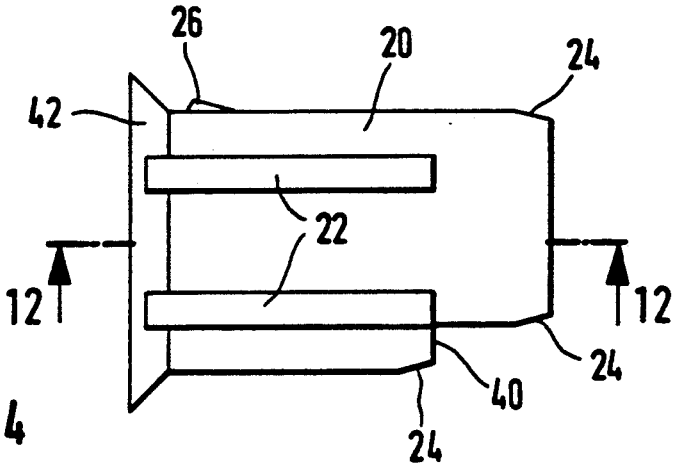
Figure 15:
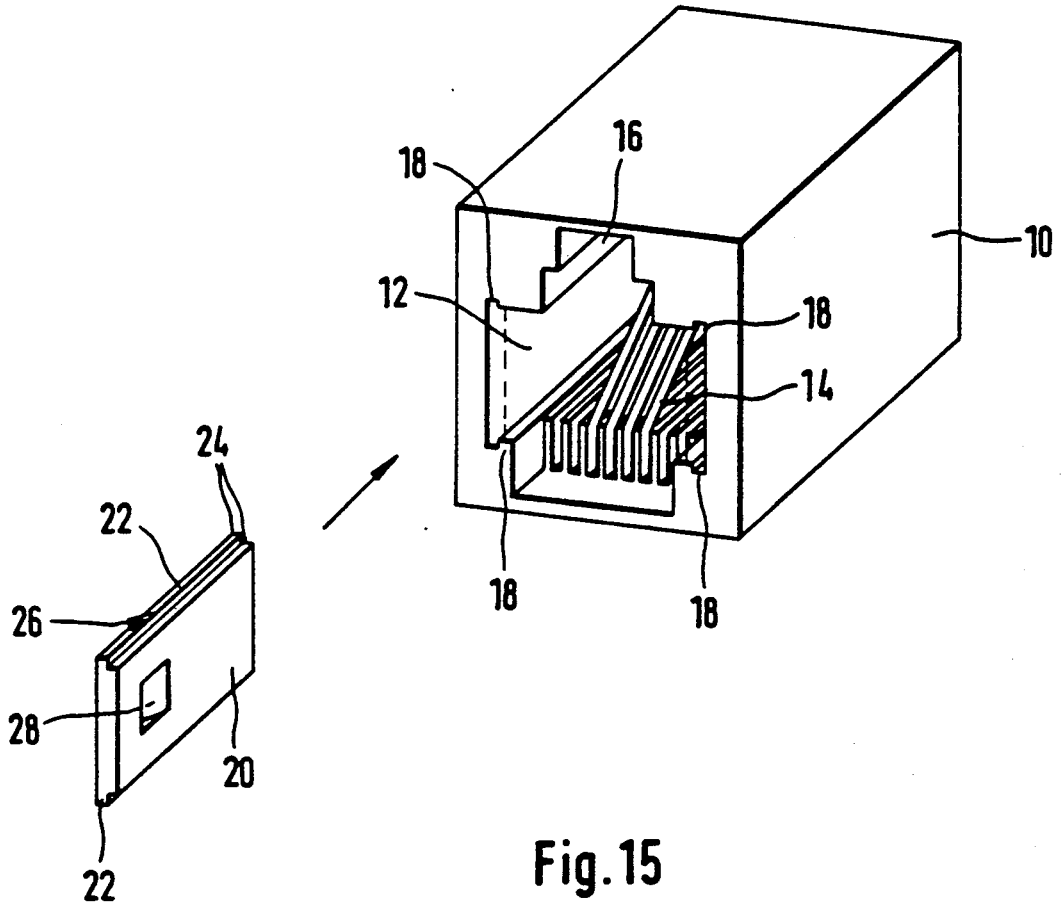

FIG. 1—is a front view of a socket of a plug connector,

FIG. 2—is a vertical, axial, sectional view of the socket;

FIG. 3—is a side elevational view of the inner side of a plate insertable into the socket on the left side, FIG. 4—is a rear view of the plate of FIG. 3, FIG. 5—is a sectional view of the plate of FIG. 3 according to section line 5—5 in FIG. 7, FIG. 6—is a side view of the plate in the view direction of FIG. 5, FIG. 7—is a view of the outer side of the plate rotated by 180° relative to FIG. 3, FIG. 8—is a front elevational view of a second embodiment of the socket, FIG. 9—is a vertical, axial, sectional view of a socket of FIG. 8, FIG. 10—is a side elevational view of the inner side of a plate insertable into the socket of FIG. 8, on the right side, FIG. 11—is a rear view of the plate of FIG. 10, FIG. 12—is a sectional view of the plate of FIG. 10 according to section line 12—12 in FIG. 14, FIG. 13—is a side elevational view of the plate in the view direction of FIG. 12, FIG. 14—is a view of the outer side of the plate rotated by 180° relative to FIG. 10, FIG. 15—is a perspective view of a socket with a plate according to a third embodiment.

The socket of the plug connector exhibits socket body 10. A snap-in body 30 is are inserted and lockingly engaged in the socket body 10. Contact terminals 14 are inserted into the snap-in body 30, where the contact terminals 14 together with the snap in body 30 are inserted into the socket body 10. The contact terminals 14 are fixed in the socket body 10 by the snap-in body 30.

The socket body 10 and the lockingly engaged snap-in body 30 surround a plug receiver 12. The snap-in body 30 forms a base face of the plug receiver 12. The contact terminals 14 are disposed side-by-side at this base face. The free ends of the contact terminals 14 protrude springingly into the plug receiver 12. The cross-section of the plug receiver 12 corresponds in the dimensions to the dimensions of a plug to be inserted into the socket, for example, of an eight-pole plug of an ISDN system.

The socket body 10 exhibits on one outer face protruding snap-in hooks 32. The socket body 10 can be lockingly engaged by way of these snap-in hooks, for example, on a printed circuit board. According to the embodiment of FIGS. 1 and 2, the snap-in hooks 32 are disposed at an outer side face of the socket body 10, disposed parallel to the plug receiver, such that the socket can be attached lying on the printed circuit board. According to the embodiment of FIGS. 8 and 9, the snap-in hooks 32 are disposed on the outer end face of the socket body 10, disposed opposite to the plug receiver 12, such that the socket can be lockingly engaged standing on the printed circuit board. The contact terminals 14 are led out with the soldering terminals 34 at the outer face of the socket body 10 furnished with snap-in hooks 32. The soldering terminals 34 can thus be set into the printed circuit board and can be soldered to the printed circuit board.

The plug receiver 12 exhibits at the side disposed opposite to the contact terminals 14 a guide recess 16 for the plug to be inserted. Snap-in protrusions 36 of the socket body 10 are furnished at the two sides of the guide recess 16. When the plug is inserted, snap-in levers of the plug engage lockingly behind the snap-in protrusions 36 of the socket body 10, in order to lock the plug in the plug receiver 12.

Furthermore end stops 38 for the plug are formed on the two sides of the plug receiver 12. These end stops 38 assure in connection with the snap-in levers, lockingly engaging behind the snap-in protrusions 36, an exact axial positioning and fixing of the plug in the plug receiver 12.

In each case, a groove 18 with a dovetail profile is formed in the two side faces of the plug receiver 12 formed by the socket body 10 according to the embodiment of FIGS. 1-7. The groove 18 runs approximately in the middle of the side face of the plug receiver 12 in insertion direction from the entrance side of the plug receiver 12 up to the front of the end stops 38. These grooves 18 allow an insertion of a plate 20 in each case resting on the right and left at the side faces of the plug receiver 12, in order to reduce the clear width of the plug receiver 12.

The plate 20, insertable on the left-hand side, is illustrated in detail in FIGS. 3-7. The plate insertable on the right hand side is formed mirror-symmetrically such that it does not have to be described here in detail.

The plate 20 exhibits a rib 22 at its outer face, disposed toward the side face of the plug receiver 12. Said rib 22 exhibits a dove profile corresponding to the dovetail profile of the groove 18. The length of the rib 22 corresponds to the length of the groove 18. The plate 20 is inserted into the plug receiver 12, whereby the rib 22 is inserted into the groove 18. The plate 20 is thereby form lockingly maintained cross to the insertion direction at the side face of the plug receiver 12.

The plate 20 exhibits at its upper edge a clamping protrusion 26. When the plate 20 is inserted, the clamping protrusion 26 presses against the base face of the plug receiver 12 and thereby force lockingly and friction-type lockingly retains the plate 20 in insertion direction in the plug receiver 12.

The plate 20 exhibits recess 28 at the inner face disposed towards the plug receiver 12. This recess 28 ends in a step on the plug-in side. The inserted plate 20 can be pulled out of the plug receiver 12 against the clamping force of the clamping protrusion 26 in that a suitable tool, for example, a screw driver is engaged and operated in said recess 28.

The plate 20 exhibits a step 40 at its inner end at the lower edge. This step 40 contacts the ends stop 38 upon insertion of the plate 20 and limits the insertion path of the plate 20. The outer edge 42 of the plate 20, disposed on the insertion side, is outwardly bevelled in order to rest at an insertion bevel 44 of the plug receiver 12. The inwardly directed corner of the plate 20 is furnished with insertion bevels 24, in order to alleviate the insertion of the plate 20 into the plug receiver 12.

In the second embodiment illustrated in FIGS. 8-14 corresponds in its construction to the socket of the precedingly described embodiment. Consequently, the same reference numerals are employed. Reference is made to the preceding description.

This embodiment exhibits in each case two parallel grooves 18 with a dovetail profile in the side faces of the plug receiver 12 in distinction to the embodiment of FIGS. 1-7. Correspondingly, two parallel ribs 22 with a dovetail profile are formed at the outer face of the plate 20.

Grooves 18, in each case running along the side faces, are formed in the floor face and in the cover face of the plug receiver 12, according to the embodiment illustrated in FIG. 15. A plate 20 can be inserted in each pair of grooves 18 disposed opposite to each other in the floor face and in the cover face. The plates 20 exhibit a thickness which is larger than the width of the grooves 18. At its upper and lower edges, the plates 20 exhibit in each case at their outer edge a rib 22 corresponding in its cross-section to the grooves 18. Otherwise, this exemplified embodiment of FIG. 15 corresponds to the preceding embodiments and reference is made to the description of the preceding embodiments.

In all exemplified embodiments, the plates 20 with the ribs 22 are single-piece plastic injection-molded parts. Similarly, the socket body 10 and the snap-in body 30 are in each case single-piece plastic injection-molded parts.

I claim:

1. A socket body for telecommunication systems open at one side to provide a chamber of rectangular cross-section with interior opposed side walls and opposed upper and lower walls said chamber being adapted for receiving a close-fitting body which supports a pre-selected number of side-by-side contact elements in the socket body adjacent the upper wall of said chamber and depending into said chamber, said socket body having a guide recess in the lower chamber wall opposite the contact elements for an insertable plug to be inserted in said chamber for engaging all of said contact elements and closely engaging the side walls of the chamber and also having respective grooves in each of its side walls for engaging and guiding a rib on each plate member of a pair of plate numbers to be inserted into said chamber to symmetrically narrow the opening between the side walls thereof when a plug is inserted in said chamber engaging less than all of said contact elements so that such plug closely engages such plates.

2. The socket according to claim 1, wherein the thickness of the plates (20) is larger than the width of the grooves (18).

3. The socket according to claim 1, wherein a clamping protrusion (26) is formed at least at one of the edges of the plates (20) running in insertion direction.

4. The socket according to claim 1, wherein a recess (28) is disposed in the inner face of the plates (20) disposed remote relative to the side face of the plug receiver (12).

5. The socket according to claim 1, characterized in that the recess (28) is disposed next to the insertion opening of the plug receiver (12).

6. The socket according to claim 1, wherein eight contact terminals (14) are disposed side-by-side in the base face of the plug receiver (12) and that the plates (20) reduce the clear width of the plug receiver (12) to the width of a six-pole plug.

7. Article in accordance with claim 1 in combination with a pair of essentially identical plate members having ribs which are matingly engagable with the grooves of said side walls.

8. Article in accordance with claim 7 wherein said grooves of said side walls are dove-tailed to matingly engage said plate members.

* * * * *